US007024773B2

(12) United States Patent
Jennings

(10) Patent No.: US 7,024,773 B2
(45) Date of Patent: Apr. 11, 2006

(54) SAFETY CUTTER WITH RETRACTING GUARD

(76) Inventor: Dale E. Jennings, 16644 Redwood St., Fountain Valley, CA (US) 92708

( * ) Notice: Subject to any disclaimer, the term of this patent is extended or adjusted under 35 U.S.C. 154(b) by 0 days.

(21) Appl. No.: 10/444,239

(22) Filed: May 23, 2003

(65) Prior Publication Data

US 2003/0229988 A1 Dec. 18, 2003

Related U.S. Application Data

(63) Continuation of application No. 09/590,236, filed on Jun. 8, 2000, now abandoned.

(51) Int. Cl.
*B26B 29/02* (2006.01)
*B26B 3/00* (2006.01)

(52) U.S. Cl. ..... 30/2; 30/151; 30/286

(58) Field of Classification Search ..... 30/2, 30/151, 162, 286, 295, 164, 293, 294, 314, 30/317, 320
See application file for complete search history.

(56) References Cited

U.S. PATENT DOCUMENTS 1,181,681 A * 5/1916 Nicaud ..... 30/151
2,512,237 A * 6/1950 Mravik ..... 30/151
3,781,988 A * 1/1974 Jones ..... 30/2
3,906,626 A * 9/1975 Riuli ..... 30/162
3,943,627 A * 3/1976 Stanley, Jr. ..... 30/151
4,091,537 A * 5/1978 Stevenson, Jr. ..... 30/286
4,523,379 A * 6/1985 Osterhout et al. ..... 30/151
4,675,996 A * 6/1987 DuBuque ..... 30/2
5,522,135 A * 6/1996 Votolato ..... 30/2
5,697,157 A * 12/1997 Votolato ..... 30/2
6,233,832 B1 * 5/2001 Berns ..... 30/162
6,560,873 B1 * 5/2003 Ortner et al. ..... 30/2
6,718,637 B1 * 4/2004 Ortner et al. ..... 30/2

* cited by examiner

*Primary Examiner*—Clark F. Dexter

(57) ABSTRACT

A safety cutter with a retracting guard. The safety cutter has a blade permanently held to the blade handle. The blade has a point which extends beyond the handle and is surrounded by a retracting guard. When enabled, the guard retracts into the handle when the guard is pressed against an object to be cut, thereby exposing the point of the blade. The safety cutter is made so that it may be operated either by a right handed person or a left handed person. A button override is also provided on each side of the handle so that the guard can be retracted by pressing only one of the buttons. Preferably, a portion of the override can be removed so that the guard can only be released by pushing the push button.

15 Claims, 4 Drawing Sheets

SAFETY CUTTER WITH RETRACTING GUARD

This application is a continuation of applicant's Ser. No. 09/590,236, filed on Jun. 8, 2000 now abandoned.

BACKGROUND OF THE INVENTION

The field of the invention is cutters and the invention relates more particularly to cutters of the type used to open boxes and bags. Such cutters are widely used in fast food restaurants, grocery stores and various establishments where shipments are made in boxes or bags which must be opened to remove the contents for sale or other processing.

One consideration for the use of such cutters in restaurants is to provide a cutter from which the blade is not removable. In the past, substantial liability has occurred from the inadvertent transfer of a blade from a cutter into the food. Even though such occurrence is extremely rare, it is conceivable. Because it is conceivable, there are persons who will put blades in the food and attempt to collect money from the owner of the business.

It is also important that the blades be guarded to reduce the possible of accidental cuts to employees. Various designs of safety cutters have been devised which typically utilize pivoting guards. One such cutter is shown in U.S. Pat. No. 3,781,988 which shows a pivoting guard. A spring is attached to the guard in such a way that it may be moved over center to hold the guard away from the blade.

Another style of safety guard is shown in U.S. Pat. No. 4,091,537 where a spring loaded blade guard moves under the cutting edge of a blade. Only when the blade guard is retracted is the blade exposed.

A cutter with a pivoting blade guard is shown in U.S. Pat. No. 4,675,996. The guard pivots up to expose the blade for cutting.

Another pivoting guard design is shown in U.S. Pat. Nos. 5,522,135 and 5,697,157. In these cutters, the guard is pivoted behind the blade and retracts when the cutter is pulled along a surface to be cut.

Most of the prior art guards are released by moving the cutter along a surface to be cut. The guards have no means for being locked in an extended position and, thus, the blade can be inadvertently exposed when it is not intended to be exposed. Furthermore, all of the blades in the above-discussed patents are removable and provide the possibility of ending up, for instance, in a final food product.

BRIEF SUMMARY OF THE INVENTION

It is an object of the present invention to provide a safety cutter which has a guard which will not retract unless a button is depressed.

It is another object of the present invention to provide a safety cutter which may be operated either by right handed persons or left handed persons.

The present invention is for a safety cutter with a retracting guard. The safety cutter has a cutter body with a handle having a front edge and a hand contacting outer surface. The cutter body has a right hand thumb contacting side and a left hand thumb contacting side. A blade is permanently held to the cutter body and has a point portion which extends outwardly from the front of the cutter body. A guard is held by the cutter body and has an extended position where it covers the point of the knife. The guard may be retracted by pressing a push button and pressing the face of the guard against the object to be cut. When pressure against the surface being cut is released, the guard springs back forward and locks to fully shield the blade. With the provision of both a right hand push button and a left hand push button, it is necessary that means be provided to override the push button on the opposite side of that which the user will depress. That is, if only one push button is depressed, the other non-depressed push button will prevent the retraction of the guard. Thus, to enable the pressing of one push button to operate the release, it is necessary to override the push button on the opposite side. A slide release is provided for this purpose. In order that a user be prevented from pressing forward both releases, means are provided for disabling the release on the side having the push button which will be depressed in operation. That is, if a right handed person is given the cutter, the release on the right hand side will be disabled so that the guard will retract only when the right hand push button is depressed. Preferably, the guard is fabricated from a transparent polymer so that the user can see the position of the knife behind the guard.

DESCRIPTION OF THE PREFERRED EMBODIMENTS

Figure 1:
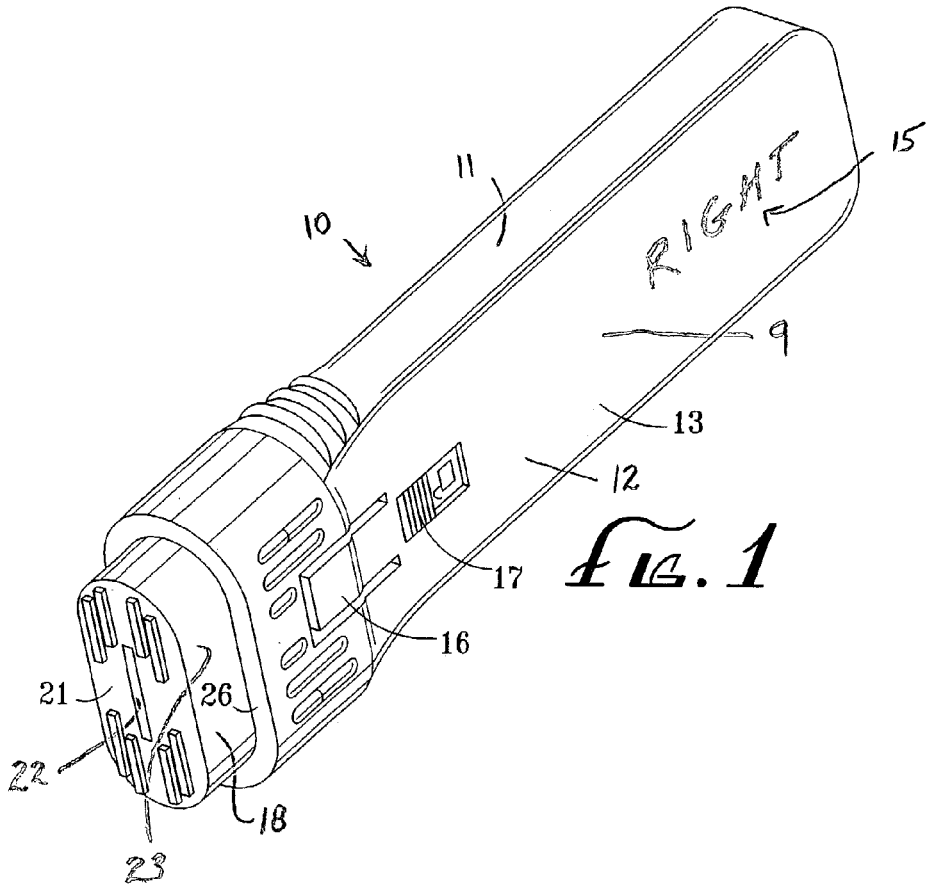
FIG. 1 is a perspective view of the cutter of the present invention showing the guard in an extended configuration.
Figure 2:
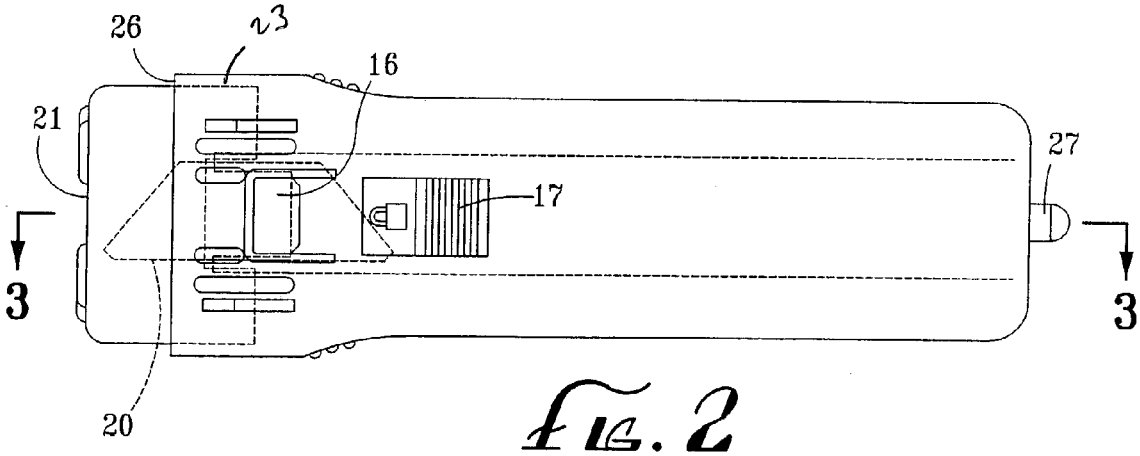
FIG. 2 is a right side view thereof.

The cutter of the present invention is shown in perspective view in FIG. 1 and indicated generally by reference character 10. Safety cutter 10 has a cutter body 9 that includes handle 11 having a hand contacting outer surface 12. Handle 11 has a right hand thumb contacting side 13 and a left hand thumb contacting side 14. Indicia 15 shows the word "right" to indicate the side on which a right handed person will hold his/her thumb. Thus, a right hand push button 16 is positioned on the side indicated by the indicia "right" in FIG. 1. Means for overriding the necessity of depressing push button 16 is shown by release slide 17 in FIG. 1. When release side 17 is moved forward, it is no longer necessary to press right hand push button 16 to release the lock on the right hand operative side of handle 11. The details of one way of doing this are discussed below. The release slide 17 is shown in FIG. 2 in its back or locked position. In this position, the depression of push button 16 will release the blade, assuming that the push button on the other side has been previously overridden.

A guard 18 extends outwardly over the point portion 19 of blade 20 to reduce the chance of injury. Guard 18 has an outer face 21 which has a central slit 22 through which the blade point portion 19 can protrude. Guard 18 has a wall area 23 which telescopically extends into handle 11 as shown in FIG. 2. Guard 18 is held in a limited movement range by the protrusion of tabs 24 into slots 25 formed in handle 11. The handle has a front edge 26 beyond which point portion 19 extends. Preferably, the cutter has a tape slitting tab 27 integrally formed on the back of handle 11.

Figures 3A, 3B, 3C:
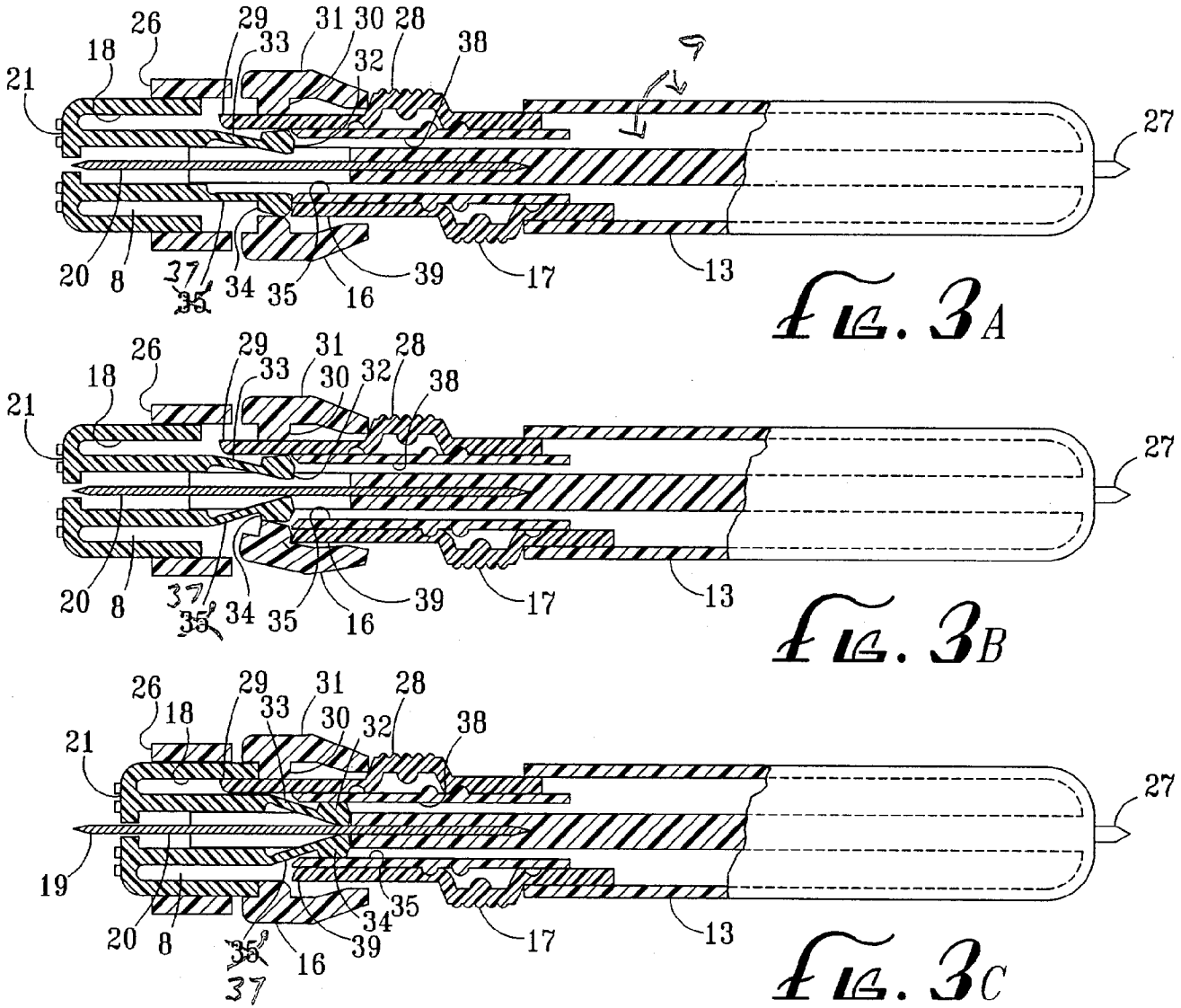
FIG. 3A is a cross-sectional view taken along line 3—3 of FIG. 2 showing the left hand push button locked open disengaging the guard lock.
FIG. 3B is a cross-sectional view taken along line 3—3 of FIG. 2 showing the left hand push button disabled and the right hand push button depressed.
FIG. 3C is a cross-sectional view taken along line 3—3 of FIG. 2 showing the guard in a retracted configuration.
Figure 4:
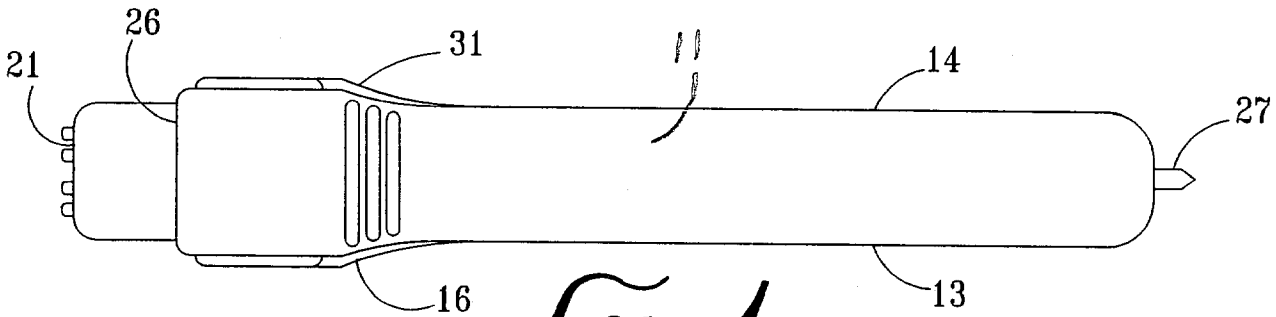
FIG. 4 is a bottom view of the cutter of FIG. 1.

The details of operation of the retracting guard are shown best in FIGS. 3A, 3B, and 3C. In FIG. 3A the release slide for left handed persons is shown near the top of FIG. 3A and indicated by reference character 28. Left hand release slide 28 is shown in a released or forward position where it can be seen that an integral longitudinally movable tab 29 has moved under a hammer portion 30 of left hand push button 31. In this position it has deflected the contact foot 32 of inwardly extending finger 33 which is integrally formed from guard 18.

On the right hand thumb contacting side 13, release slide 17 has not been moved forward and, thus, the contact foot 34 of right hand side inwardly extending finger 37 will abut right hand side lock tab 35. This will prevent guard 18 from being retracted. However, when right hand push button 16 is depressed as shown in FIG. 3B, the right hand side inwardly extending finger 37 will move inwardly with respect to right hand stop or lock tab 35, thereby permitting the retraction of guard 18, as shown in FIG. 3C. Longitudinally movable tab 39 is moved by pushing release slide 17 forward. This bypasses the need to press push button 16 to release the guard lock. When guard 18 is retracted, the point portion 19 of blade 20 is exposed for cutting. The retraction of guard 18 is caused by the contact between the box or other object to be cut and the outer face 21 of guard 18. Similarly, when release slide 28 is in its rearward position, contact foot 32 will abut lock tab 38, preventing guard 18 from retracting.

It is beneficial to avoid the disabling of both push buttons. The cutter shown in FIGS. 1 through 7 can be operated like the prior art cutters by moving both of the release slides 17 and 28 forward. This can be accomplished by adding a notch 40, shown best in FIG. 11, which permits the removal of the break-away end portion 41. Similarly, longitudinally movable tab 39 has a break-away portion 42 connected via a notch 43 thereto.

Figures 8, 9, 10, 11, 12:
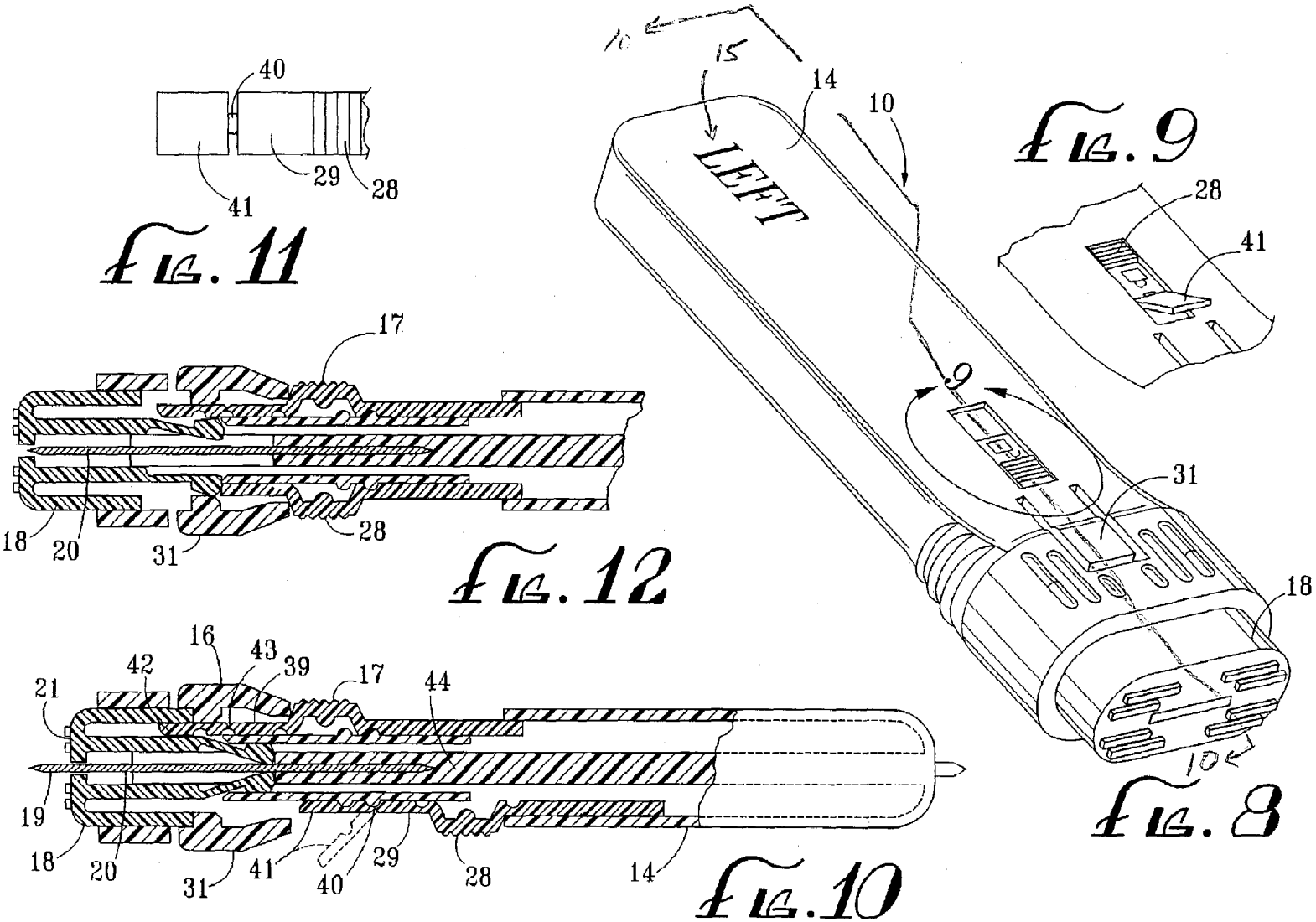
FIG. 8 is a perspective view showing the front, left side and bottom of cutter 10.
FIG. 9 is an enlarged perspective view of the slide lock with the removable tab portion of FIG. 8.
FIG. 10 is a cross-sectional view taken generally along line 10—10 of FIG. 8 showing the break-out tab being removed.
FIG. 11 is an enlarged front view of the removable break-out tab shown in FIG. 10.
FIG. 12 is a cross-sectional view showing the cutter after the removal of the break-out tab with the release slides both in a forward position.

Thus, as shown best in FIG. 12, even though left hand release slide 28 is moved forward, it no longer is capable of disabling left hand push button 31. In use, when cutter is handed to a left handed employee, the manager will remove break-away end portion 41 as shown in FIG. 9 by prying it up and pulling it off. He then hands it to the employee who can now only operate the cutter by depressing push button 31. That is, the guard will not retract unless push button 31 is pushed, even though left hand release slide 28 is moved forward. Of course, the right hand release slide 17 also must be moved forward to disable right hand push button 16. Once the guard has been removed, the guard will spring back and lock over the blade.

Thus, not only is the employee protected against inadvertent accidental injury by contact with point portion 19, the customers are protected against the accidental falling out of a removable blade into the food. That is because knife blade 20 is permanently embedded in knife support arm 44.

Figure 6:
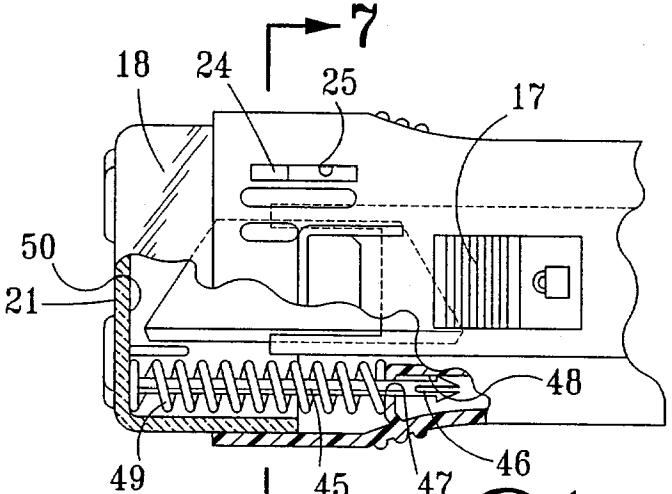
FIG. 6 is a right side view partially cut away showing the spring for urging the guard outwardly.
Figure 5:
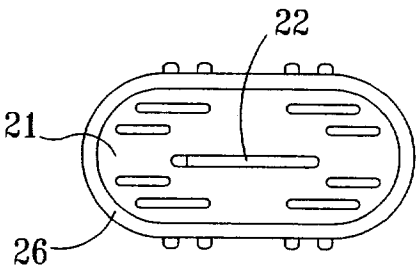
FIG. 5 is a front view thereof.
Figure 7:
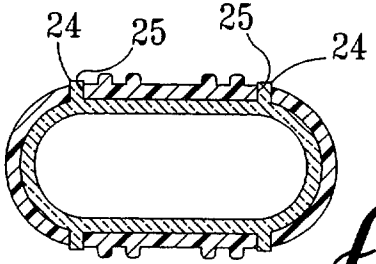
FIG. 7 is a cross-sectional view taken along line 7—7 of FIG. 6.

One means for biasing the guard 18 in an outward position is indicated best in FIG. 6 of the drawings. There a spring support pin 45 has a slotted distal point 46 which snaps through a hole 47 in the end of spring cavity 48. Spring 49 abuts the inner surface 50 of outer face 21.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A safety cutter (10) with a retracting guard (18) comprising:

a cutter body (9) having a handle (11) with a front edge (26), a hand-contacting outer surface (12), said cutter body (9) having a right-hand-thumb contacting side (13) and a left-hand-thumb contacting side (14);

a blade (20) held to said cutter body (9) and having a point portion (19) extending outwardly with respect to said front edge (26);

a guard (18) held by said cutter body (9), said guard (18) having an outer face (21), a wall (23) extending inwardly from said outer face (21), said guard (18) being movable between a safety extended position and a retracted cutting position and which wall (23) of said guard (18) surrounds said point portion (19) when in its safety, extended position and which guard (18) retracts to expose said point portion (19) when in its retracted cutting position and said guard (18) being biased outwardly to urge said guard (18) into its safety extended position;

a right hand (16) and a left hand (31) button held by said cutter body (9), one operable on said right-hand-thumb contacting side (13) and the other operable on said left-hand-thumb contacting side (14), said right hand (16) and left hand (31) buttons having a normal position wherein the guard (18) can not be retracted and an operated position wherein the guard (18) can be retracted; and means for overriding at least one of said right hand (16) and said left hand (31) buttons so that the guard (18) can be retracted when the other of said right hand (16) and left hand (31) buttons is operated.

2. The safety cutter (10) of claim 1 wherein said means for overriding further includes means for disabling the means for overriding whereby when the means for disabling the means for overriding is activated, the guard (18) will retract only when the button is operated.

3. The safety cutter (10) of claim 1 wherein the cutter body (9) has a hollow portion and a part of said guard (18) extends within said hollow portion and the guard (18) is prevented from retracting by a contact between a lock tab (35) and said part of said guard (18) which extends within said hollow portion of said handle (11).

4. The safety cutter (10) of claim 3 wherein said guard (18) has at least a right hand part (34) and a left hand part (33) which extend within said hollow portion and said handle (11) includes a right hand stop (35) and a left hand stop (38) which are positioned so that they contact the right hand part (34) and the left hand part (33) respectively when the right hand button (16) and the left hand button (31) are in their normal position.

5. The safety cutter (10) of claim 4 wherein said right hand (16) and left hand (31) buttons are push buttons and the depression of one of said right hand (16) and left hand (31) buttons deflects one of said right hand stop (35) and left hand stop (38) respectively.

6. The safety cutter (10) of claim 5 wherein said means for overriding at least one of said right hand (16) and said left hand (31) push buttons comprises a longitudinally movable tab (29,39) moved by a slide button (17,28) which longitudinally movable tab (29,39) moves under said button (16,31) to override said button.

7. The safety cutter (10) of claim 6 wherein said means for overriding comprises a removable end portion (41) of said longitudinally movable tab (29,39).

8. The safety cutter (10) of claim 7 wherein said removable end portion (41) is joined to said longitudinally movable tab (29,39) by a weakened line (40) whereby the removable end portion (41) can be broken away from the longitudinally movable tab (29,39).

9. The safety cutter (10) of claim 1 wherein said guard (18) is fabricated from a transparent polymer.

10. A safety cutter (10) with a retracting guard (18) comprising:

a cutter body (9) having a hollow handle (11) with a front edge (26), a hand-contacting outer surface (12), said cutter body (9) having a right-hand-thumb contacting side (13) and a left-hand-thumb contacting side (14);

a blade (20) permanently held to said cutter body (9) within said hollow handle (11) and said blade (20) having a point portion (19) extending outwardly with respect to said front edge (26);

a guard (18) telescopically held by said cutter body (9), said guard (18) having an outer face (21), a wall (23) extending inwardly from said outer face (21), said guard (18) being movable between a safety extended position and a retracted cutting position and which wall (23) of said guard (18) surrounds said point portion (19) when in its safety, extended position and which guard (18) retracts to expose said point portion (19) when in its retracted cutting position and said guard (18) being biased outwardly to urge said guard (18) into its safety extended position and said guard (18) and said cutter body (9) having lock-out means to prevention the retraction of the guard (18);

a right hand (16) and a left hand (31) push button held by said cutter body (9), one extending from said right-hand-thumb contacting side (13) and the other from said left-hand-thumb contacting side (14), said right hand (16) and left hand (31) push buttons having a normal position wherein the guard (18) can not be retracted and a depressed position wherein said lock-out means is disabled and the guard (18) can be retracted; and means for overriding at least one of said right hand (16) and said left hand (31) push buttons so that the guard (18) can be retracted when the other of said right hand (16) and left hand (31) push buttons is depressed.

11. The safety cutter (10) of claim 10 wherein said guard (18) has a right hand (34) and a left hand (33) inwardly extending finger and said hollow handle (11) has a right hand (35) and a left hand (38) stop positioned to abut said right (34) and left hand (33) inwardly extending fingers to prevent the retraction of said guard (18).

12. The safety cutter (10) of claim 11 wherein said right hand (34) and left hand (33) fingers are positioned under said right hand (16) and left hand (31) push buttons so that the depression of a right hand (16) push button will deflect said right hand inwardly extending finger (34) so that it will no longer abut said right hand stop (35) and the depression of a left hand push button (31) will deflect said left hand inwardly extending finger (33) so that it will no longer abut said left hand stop (38).

13. The safety cutter (10) of claim 12 wherein said means for overriding comprises a right hand (17) and a left hand (28) slide switch, each slide switch (17,28) having a tab (39,29) affixed thereto which, when a right hand (17) or a left hand (28) slide switch is moved forward the corresponding right hand (39) or left hand (29) tab affixed thereto will move between the right hand (16) or left hand (31) push button and the corresponding right hand (34) or left hand (33) inwardly extending finger and deflect said finger so that it will not stop the inward movement of said guard (18).

14. The safety cutter (10) of claim 13 further including a break away end portion (41) on each of said right hand (39) and left hand (29) tabs, said break away end portion (41) being sufficiently large so that if the right hand break-away end portion (41) is removed, the right hand slide switch (17) will no longer deflect the right inwardly extending finger (34) and if the left hand end portion is removed, the left hand slide switch (28) will no longer deflect the left inwardly extending finger (33).

15. The safety cutter (10) of claim 12 wherein said guard (18) is fabricated from a transparent polymer.

* * * * *